United States Patent [19]

Fischer

[11] 4,403,690

[45] Sep. 13, 1983

[54] SLIDE-UP HANDLE

[76] Inventor: David Fischer, 12 Cavotti Crescent, Downsview, Ontario, Canada, M3H 4V1

[21] Appl. No.: 342,213

[22] Filed: Jan. 25, 1982

[51] Int. Cl.[3] ..... B65D 5/46; B65D 75/00

[52] U.S. Cl. ..... 206/163; 206/166; 206/180; 229/52 B

[58] Field of Search ..... 206/163, 164, 165, 166, 206/167, 180, 200, 427, 428, 435; 229/52 A, 52 B, 52 BC

[56] References Cited

U.S. PATENT DOCUMENTS

| | | | |
|---|---|---|---|
| 2,609,137 | 9/1952 | Toensmeir | 206/166 |
| 3,511,434 | 5/1970 | Dews | 206/166 |

FOREIGN PATENT DOCUMENTS

| | | | |
|---|---|---|---|
| 940884 | 1/1974 | Canada | 206/166 |
| 934590 | 8/1963 | United Kingdom | 206/166 |

*Primary Examiner*—George E. Lowrance

*Assistant Examiner*—Jimmy G. Foster

[57] ABSTRACT

A slide-up handle useful for example in beer boxes is formed from a partition panel and a handle panel. A first handle member is cut from the partition and a second handle forms a portion of the handle panel and the two handles are foldably interconnected at their top edge by a fold line connection. The first handle is provided with a pair of lateral abutments. A pair of straps are positioned one on each side of the second handle and have one end of each strap foldably connected to the handle panel and the opposite end foldably connected to the partition panel by means of fold lines. The lateral spacing of the straps relative to the handle is less than the distance the shoulders project laterally from the handle and the distance between the fold line connection between the two handles and the shoulders and between the fold line connection and the fold lines connecting the straps to the handle panel being substantially equal so that when the handle is moved to an extended position the shoulders are in a position to engage beneath the connecting straps.

6 Claims, 7 Drawing Figures

SLIDE-UP HANDLE

FIELD OF THE INVENTION

The present invention relates to a handled partition structure, more particularly the present invention relates to a slide-up handle.

BACKGROUND OF THE INVENTION

The concept of the slide-up handle particularly for use in beer boxes carrying twelve bottles in two rows of six has been with us for some period of time. Initially the cartons with the slide-up type handles were incorporated into top load boxes having both longitudinally and transverse partitions. These were replaced in some areas by end load type cartons having only a longitudinal partition some of which were provided with a handle, not necessarily a slide-up type. A handle currently used in some of the cartons used by the brewing industry in Ontario is illustrated in Canadian Pat. No. 940,884 issued Jan. 29, 1974 to Dewhurst and comprises a longitudinal partition formed into an envelope with a handle contained within and projecting up through the envelope. The envelope is mounted in a carton and the handle is movable through the top of the envelope from a retracted to an operative position wherein the handle projects above the top of the carton in a position for carrying. Many versions of slide-up handles have been used and the public has become accustomed to carrying their beer in this manner.

It has also been proposed to use handle structures that are connected to the central panel by accordian type pleats that unfold as the handle is moved from a retracted to an extended position. Such a device is shown for example in Canadian Pat. No. 884,165 issued Oct. 26, 1971 to Edwards and in Canadian Pat. No. 803,860 issued Jan. 14, 1969 to Lemon as well as No. 911,389 issued Oct. 3, 1972 to Hagedorn.

BRIEF DESCRIPTION OF THE INVENTION

It is the object of the present invention to provide handle partition structure generally requiring less material and thus normally being less expensive than other slide-up handle structures currently used in the industry while retaining adequate strength characteristics.

Broadly the present invention comprises a partition structure including a partition panel, a handle cut in said partition panel, said handle having a pair of shoulders extending laterally one from each side of the handle and spaced from the top of the handle, a handle panel, means defining a second handle in said handle panel, a top edge of said second handle being foldably connected to the top of said first handle by a fold line connection, connecting straps positioned one on each side of said second handle foldably connected at one end to said handle panel and at their oppposite ends to said partition by means of fold lines, said straps being laterally spaced from said handle and said second handle by a distance less than the distant said shoulders project laterally from said handle the distances between said fold line connection and said shoulders and between said fold line connection and said fold lines that connect said straps to said handle panel being substantially equal so that said shoulders are in a position to engage said connecting straps when said handle is moved to an extended position. Preferably the handle panel will be provided with laterally extending abutments adapted to engage the bottom of the top panel of the carton when the handle is in the extended position.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figures 1, 5, 7:
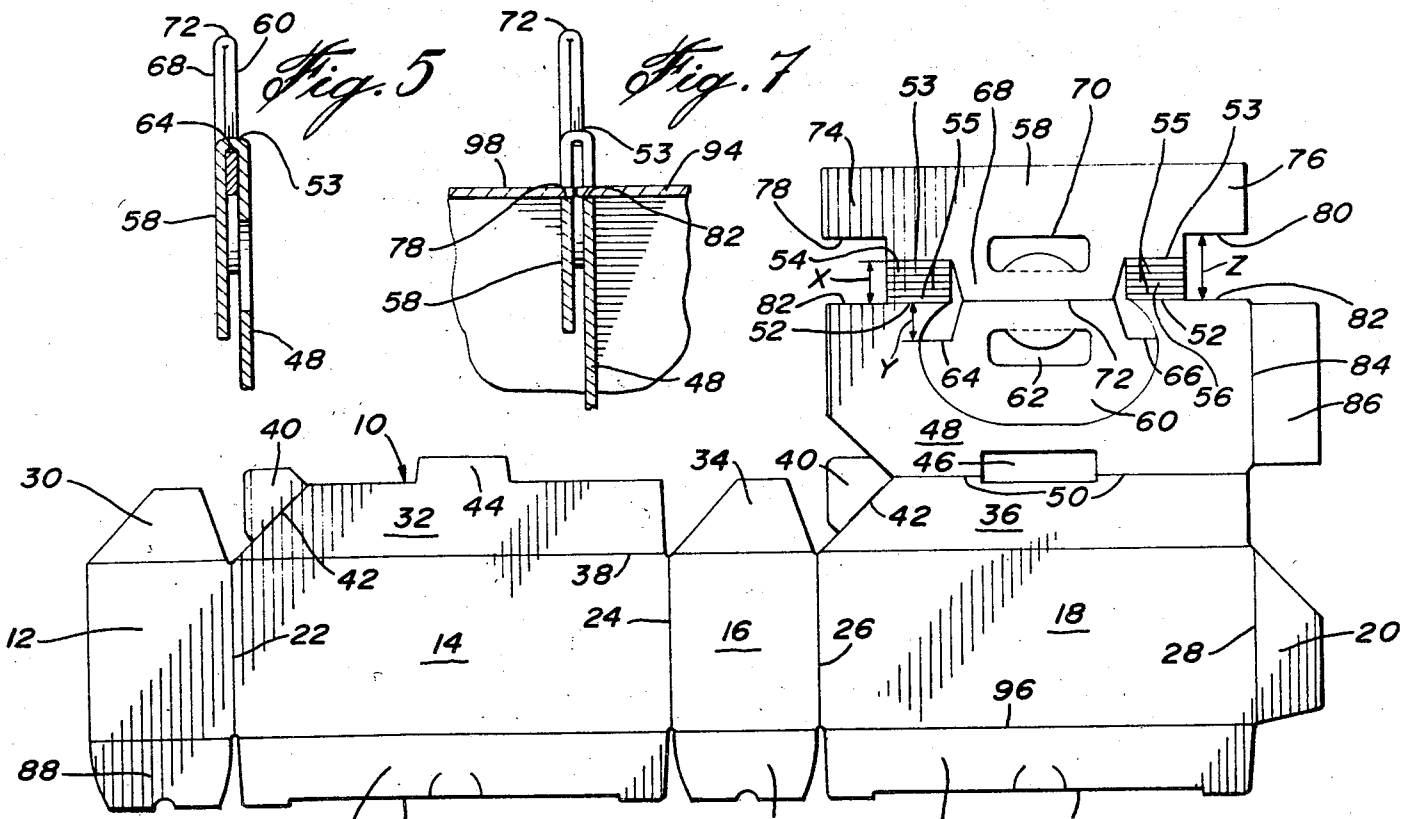
FIG. 1 is a plan view of a carton blank incorporating the present invention.
FIG. 5 is a section along the line 5—5 of FIG. 4.
Figure 2:
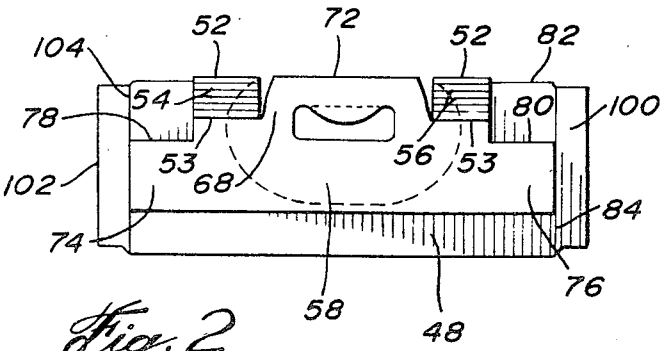
FIG. 2 is a view of a partition structure per se incorporating the present invention showing the handle panel folded into position.

The embodiment illustrated in FIG. 1 incorporates the handle and partition structure of the present invention in one specific type of carton however it may obviously be applied to a variety of different cartons and may be a separate and discrete element for insertion into a carton such as the partition element shown in the embodiment of FIG. 2.

Referring to FIG. 1 the carton illustrated is formed from a blank having an end wall panel 12, front wall panel 14, second end wall panel 16, a rear wall panel 18 and a manufacturers joint forming flap 20 foldably interconnected by a set of substantially parallel fold lines 22, 24, 26 and 28 respectively.

The particular structure shown in the FIG. 1 is provided with bottom flaps adapted to form a self erecting bottom in the well known manner. These bottom flaps 30, 32, 34 and 36 are foldably connected to their respective end wall or front or rear walls via a fold line 38 extending substantially perpendicular to the fold lines 22, 24, 26 and 28. The flaps 32 and 36 connected to the front and rear walls are provided with tabs 40 foldably connected to their end edges via diagonally extending fold line 42 extending at about 45° to fold line 38.

The flap 32 is provided with a projection 44 adapted to be received within the aperature 46 formed in the partition panel 48 as will be described hereinbelow.

In the illustrated arrangement the flap 36 has a partition panel 48 foldably connected thereto via fold line 50 substantially parallel to fold line 38. It will be noted that the hole or aperature 46 interrupts the fold line 50 and is located immediately adjacent the bottom flap 36.

The partition panel 48 has connected thereto via fold lines 52, a pair of spaced connecting straps 54 and 56. The opposite end of the straps 54 and 56 are connected with a handle panel 58 via fold lines 53 substantially parallel to the fold line 52. These connecting straps 54 and 56 are preferably provided with a plurality of substantially parallel fold lines 55 parallel to the fold lines 52 and 53 to facilitate folding of the straps as the handle is extracted to an operative position as will be described hereinbelow.

A first handle 60 is cut from the panel 48 and is provided with hand hold 62 and on opposite sides with a pair of shoulders 64 and 66. These abutment edges 64 and 66 extend laterally from the handle 60 and overlap with the fold lines 52 and the straps 54 and 56 respectively in vertical planes.

A second handle 68 projects from the handle panel 58 between the two connecting straps 54 and 56 and is connected at its top edge to the top edge of the handle 60 via fold line 72 so that the top edges of both handles 60 and 68 are interconnected. A suitable hand hole 70 is formed in handle 68 in a position to coinside with hand hole 62 in the handle 60 when the handles 60 and 68 are folded along fold line 72 into face relationship.

Preferably the handle panel 58 will be provided with a pair of laterally projecting members 74 and 76 forming abutment edges 78 and 80 respectively which will contact the bottom surface of the top wall i.e. in the illustrated arrangement will substantially align with the top edge 82 of the partition 48 when the handles are in extended position.

The distance X defining the length of the connecting straps 54 and 56 in the illustrated arrangement will be substantially equal to the distance Y i.e. the distance between the end of the straps 54, 56 and the abutment edges 64 and 60 respectively The distances X and Y as above indicated are equal and are in effect the distances between the fold line connection 72 between the handles 60 and 68 and the fold lines 53 connecting the straps 54 and 56 with the handle panel 58 and the distance between the said fold line 72 and the adjacent surfaces of the abutments 64 and 66 respectively.

The distance Z between the edges 78 and 80 formed on the abutments on the panel 58 and the fold line 72 will be equal to the distance between the fold line 72 and the bottom face of the top closure of the carton when the handle is in operative position if the abutment edges 78 and 80 are to function to reinforce the handle when carrying a full and closed carton. In the illustrated arrangement where the fold line 52 is lined with the fold line 72 and is positioned immediately adjacent the bottom of a top closure as will be described hereinbelow the distance Z will be equal to twice the distance X or Y.

A fold line 84 connects a positioning flap 86 to the side edge of the partition panel 48.

In the illustrated arrangement of FIG. 1 the top of the carton is formed by flaps 88, 90, 92 and 94 foldably connected to the top edges of the panels 12, 14, 16 and 18 via fold line 96. The flaps 90 and 94 are cut out as indicated at 98 with an indentation adapted to permit the connecting strips 54 and 56 and the handles 68 and 60 to pass when they are pulled to extended position through the top of the carton.

To produce the partition structure the handle panel 58 and connecting strips 54 and 56 are folded on fold lines 52 and 72 overlapping relationship with the partition panel 48. This moves the handle 60 into face to face relationship with the handle 68. Preferably the handle 60 will be adhesively secured to the handle 68 and thus to the handle panel 58.

The arrangement shown in FIG. 2 is an independent partition structure wherein the positioning flap 86 of FIG. 1 has been replaced by a connecting flap 100 and second flap 102 is connected to the opposite end of the panel 48 via fold line 104 i.e. to connect the partition 48 to the carton the flaps 100 and 102 would be secured to the end walls of the carton in a conventional manner e.g. by adhesive.

Figure 3:
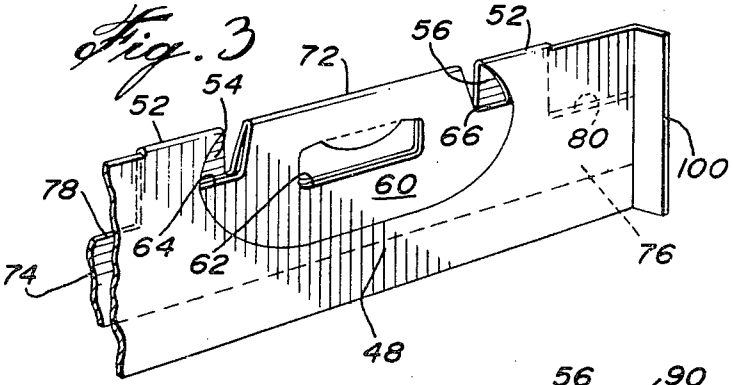
FIG. 3 is a partial view similar to FIG. 2 but viewed from the opposite side.

The structure of FIG. 2 is also illustrated in FIG. 3 but from the opposite face with parts omitted.

Figure 4:
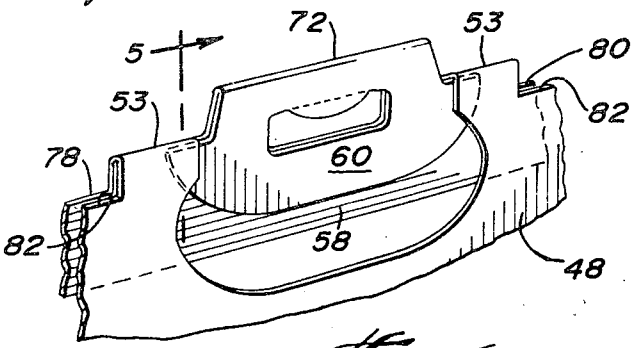
FIG. 4 is a partial isometric view illustrating the partition with the handle in extended position.

FIG. 4 shows the handle structure in operative position i.e. with the handle extended and the connecting straps 54 and 56 moved to their extended positions. This view is taken from the same side as the view of FIG. 3. It will be noted that the shoulders 64 and 66 engage with the ends of the straps 54 and 56 remote from their fold line connection to the partition panel 48 i.e. at their fold line connection with the panel 58. This engagement of the shoulders 64 and 66 under the fold lind 52 tends to reinforce the handle (see also FIG. 5).

Figure 6:
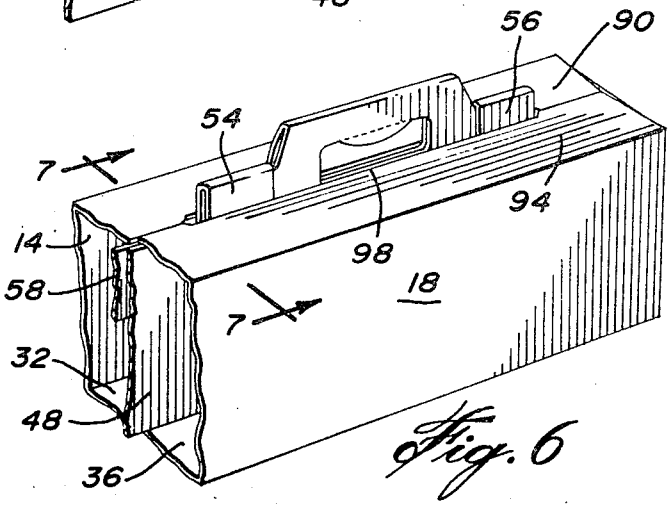
FIG. 6 is a partial isometric view of a carton incorporating the present invention with the handle in extended position and, FIG. 7 is a section along the line 7—7 of FIG. 6.

The handle structure may be further reinforced by the edges 78 and 80 of the projection 74 and 76 being moved into engagement with the bottom of the top wall of the carton formed by the flaps 88, 90, 92 and 94 when the handle is extended. In operation the handle is extended by flexing along the parallel fold lines until the position illustrated in FIG. 6 is reached wherein the handle as well as the connecting straps 54 and 56 are projected through the aperature formed by the cutouts 98 in the panels 90 and 94 to extend well above the top of the carton to provide ease of holding. The shoulders 64 and 66 are engaged under the fold lines 52 adjacent the panel 58 (see FIG. 4) and the edges 78 and 80 move into engagement with the underside of the flap, in this case the flap 90 (see FIG. 7), so that further movement of the handle outwardly is prevented by the full extension of the steps 54 and 56, engagement of the shoulders 64 and 66 with the fold lines 52 and engagement of the edges 78 and 80 with the bottom of the top wall.

The disclosure has dealt primarily with top load cartons but it will be apparent that the handle structure incorporated in the partition may be incorporated in the partition of an end load structure or any other convenient structure.

Modifications will be evident to those skilled in the art without departing from the spirit of the invention as defined in the appended claims.

I claim:

1. A handle structure for application to cartons comprising a first panel, a handle cut in said first panel, said handle having a pair of shoulders extending laterally one from each side of said handle, a handle panel, means defining a second handle in said handle panel, the top edges of said handle and said second handle being connected by a fold line connection, connecting straps positioned one on each side of said second handle and foldably connected at one end to said handle panel and at its opposite end to said first panel by means of fold lines substantially parallel to said fold line connection, said straps being laterally spaced from said handle by a distance less than the distance said shoulders project laterally from said handle the lengths of said straps between said fold lines connecting each said straps to said first panel and said handle panel and the distances between said shoulders and said fold lines connecting said straps to said first panel being substantially equal so that when said handle panel is folded into face-to-face relation with said first panel and said handle is moved to an extended position said shoulders are in a position to engage said connecting straps adjacent said fold lines connecting said straps to said handle panel.

2. A handle structure as defined in claim 1 wherein said first panel comprises a partition panel.

3. A carton structure as defined in claim 1 or 2 wherein said handle panel is provided with a pair of lateral abutments spaced from said fold line connection by a distance such that movement of said handle the length of said connecting straps into extended position brings said abutments into contact with a bottom face of a top closure of said carton.

4. A partition structure as defined in claim 1, 2 or 3 wherein said straps are provided with a plurality of spaced fold lines traversing said straps and being substantially parallel to said fold line connection to facilitate folding of said straps as said handle is moved to said extended position by flexing of said straps.

5. A handle structure as defined in claim 2 wherein said straps extend upwardly from the top of said partition panel to said handle panel when said handle is in said extended position.

6. A handle structure as defined in claim 5 wherein said straps are provided with a plurality of spaced fold lines traversing said straps and being substantially parallel to said fold line connection to facilitate folding of said straps as said handle is moved to said extended position by flexing of said straps.

* * * * *